US007938168B2

(12) United States Patent
Lee et al.

(10) Patent No.: US 7,938,168 B2
(45) Date of Patent: May 10, 2011

(54) CERAMIC CORES, METHODS OF MANUFACTURE THEREOF AND ARTICLES MANUFACTURED FROM THE SAME

(75) Inventors: Ching-Pang Lee, Cincinnati, OH (US); Hsin-Pang Wang, Rexford, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/567,521

(22) Filed: Dec. 6, 2006

(65) Prior Publication Data

US 2008/0190582 A1 Aug. 14, 2008

(51) Int. Cl.
*B22C 9/00* (2006.01)
*B22C 9/10* (2006.01)

(52) U.S. Cl. ..... 164/516; 164/28; 164/369

(58) Field of Classification Search ..... 164/28, 164/228, 516, 34, 35, 361, 369
See application file for complete search history.

(56) References Cited

U.S. PATENT DOCUMENTS 3,220,972 A 11/1965 Lamoreaux
3,516,946 A 6/1970 Modic
3,715,334 A 2/1973 Karstedt
3,775,452 A 11/1973 Karstedt
4,288,345 A 9/1981 Ashby et al.
4,323,756 A 4/1982 Brown et al.
4,421,153 A * 12/1983 Wilkinson et al. ..... 164/35
4,421,903 A 12/1983 Ashby
4,724,299 A 2/1988 Hammeke
4,730,093 A 3/1988 Mehta et al.
5,014,763 A 5/1991 Frank
5,038,014 A 8/1991 Pratt et al.
5,043,548 A 8/1991 Whitney et al.
5,250,136 A * 10/1993 O'Connor ..... 156/272.2
5,337,568 A 8/1994 Lee et al.
5,397,215 A 3/1995 Spear et al.
5,601,737 A 2/1997 Asahi et al.
5,931,638 A 8/1999 Krause et al.
6,017,186 A 1/2000 Hoeger et al.
6,142,734 A * 11/2000 Lee ..... 416/97 R
6,254,334 B1 7/2001 LaFleur
6,255,000 B1 * 7/2001 O'Connor et al. ..... 428/586

(Continued)

OTHER PUBLICATIONS

Harvey et al; Non-Axisymmetric Turbine End Wall Design: Part 1 Three-Dimensional Linear Design System; ASME Paper; 99-GT-337; Presented at the International Gas Turbine & Aeroengine Congress & Exhibition, Indianapolis, Indiana; 8 pages; Jun. 7-Jun. 10, (1999 ).

(Continued)

*Primary Examiner* — Kevin P Kerns
(74) *Attorney, Agent, or Firm* — Cantor Colburn LLP

(57) ABSTRACT

Disclosed herein is an integral casting core including a solidified first portion of a ceramic core and a solidified second portion of the ceramic core; wherein the solidified second portion is disposed upon the solidified first portion of the ceramic core by laser consolidation. The first solidified portion of the integral casting core, is manufactured by a process which includes disposing a slurry including ceramic particles into a metal core die; wherein an internal volume of the metal core die has a geometry equivalent to a portion of the geometry of the integral casting core; curing the slurry to form a cured first portion of the ceramic core; and firing the cured first portion of the ceramic core to form a solidified first portion of the ceramic core.

8 Claims, 3 Drawing Sheets

U.S. PATENT DOCUMENTS

| | | | | |
|---|---|---|---|---|
| 6,269,540 | B1 | 8/2001 | Islam et al. | |
| 6,283,713 | B1 | 9/2001 | Harvey et al. | |
| 6,338,609 | B1 | 1/2002 | Decker et al. | |
| 6,379,528 | B1 | 4/2002 | Lee et al. | |
| 6,402,464 | B1 | 6/2002 | Chiu et al. | |
| 6,419,446 | B1 | 7/2002 | Kvasnak et al. | |
| 6,429,402 | B1 | 8/2002 | Dixon et al. | |
| 6,502,622 | B2 | 1/2003 | Lee et al. | |
| 6,504,127 | B1 | 1/2003 | McGregor et al. | |
| 6,511,294 | B1 | 1/2003 | Mielke et al. | |
| 6,546,730 | B2 | 4/2003 | Johnson et al. | |
| 6,561,761 | B1 | 5/2003 | Decker et al. | |
| 6,578,623 | B2 * | 6/2003 | Keller et al. | 164/369 |
| 6,626,230 | B1 | 9/2003 | Woodrum et al. | |
| 6,669,445 | B2 | 12/2003 | Staubach et al. | |
| 6,733,907 | B2 | 5/2004 | Morrison et al. | |
| 6,974,308 | B2 | 12/2005 | Halfmann et al. | |
| 7,134,842 | B2 | 11/2006 | Tam et al. | |
| 2005/0006047 | A1 | 1/2005 | Wang et al. | |
| 2005/0070651 | A1 | 3/2005 | McNulty et al. | |
| 2005/0156361 | A1 | 7/2005 | Holowczak et al. | |
| 2005/0205232 | A1 | 9/2005 | Wang et al. | |
| 2006/0065383 | A1 | 3/2006 | Ortiz et al. | |
| 2006/0140768 | A1 | 6/2006 | Tam et al. | |
| 2006/0153681 | A1 | 7/2006 | Lee | |
| 2006/0233641 | A1 | 10/2006 | Lee et al. | |
| 2006/0275112 | A1 | 12/2006 | Lee et al. | |
| 2007/0003416 | A1 | 1/2007 | Bewlay et al. | |
| 2007/0160476 | A1 | 7/2007 | Cheng et al. | |

OTHER PUBLICATIONS

Krauss et al; "Rheological Properties of Alumina Injection Feedstocks"; Materials Research; 8; pp. 187-189; (2005).

Sieverding; "Secondary Flows in Straight and Annular Turbine Cascades"; in Thermodynamics and Fluid Mechanics of Turbomachinery, vol. II; Eds. A.S. Ucer, P. Stow, and Ch. Hirsch; NATO ASI Series; Martinus Nijhoff Publishers; pp. 621-664; (1985).

Shih et al; "Controlling Secondary-Flow Structure by Leading-Edge Airfoil Fillet and Inlet Swirl to Reduce Aerodynamic Loss and Surface Heat Transfer"; Transactions of the ASME; 125; pp. 48-56; Jan. (2003).

Takeishi et al; "An Experimental Study of the Heat Transfer and Film Cooling on Low Aspect Ratio Turbine Nozzles"; The American Society of Mechanical Engineers, 345 E. 47$^{th}$ St., New York, N.Y. 10017; ASME Paper 89-GT-187; Presented at the Gas Turbine and Aeroengine Congress and Exposition, Jun. 4-8, Toronto, Ontario Canada; 9 pages (1989).

Theiler, et al.; "Deposition of Graded Metal Matrix Composites by Laser Beam Cladding"; Bias Bremen Institute of Applied Beam Technology, Germany; http://www.bias.de/WM/Publikationen/Deposition%20of%20graded.pdf; 10 pages; Jun. 2005.

U.S. Appl. No. 11/256,823, filed Oct. 24, 2005; "Ceramic-Based Molds for Industrial Gas Turbine Metal Castings Using Gelcasting"; Huang et al.

U.S. Appl. No. 11/540,741, filed Sep. 29, 2006; "Turbine Angel Wing Sealing Using Surface Depression Treatment"; Bunker, Ronald Scott.

U.S. Appl. No. 11/240,837, filed Sep. 30, 2006; "Methods for Making Ceramic Casting Cores and Related Articles and Processes"; H.P. Wang et al.

U.S. Appl. No. 11/567,409, filed Dec. 6, 2006, "Casting Compositions for Manufacturing Metal Castings and Methods of Manufacturing Thereof"; Hsin-Pang Wang et al.

U.S. Appl. No. 11/567,443, filed Dec. 6, 2006; "Disposable Insert, and Use Thereof in a Method for Manufacturing an Airfoil"; Ching-Pang Lee.

U.S. Appl. No. 11/567,477, filed Dec. 6, 2006; "Composite Core Die, Methods of Manufacture Thereof and Articles Manufactured Therefrom"; Ching-Pang Lee et al.

U.S. Appl. No. 11/635,749, filed Dec. 7, 2006; "Processes for the Formation of Positive Features on Shroud Components, and Related Articles"; Ching-Pang Lee.

U.S. Appl. No. 11/609,117, filed Dec. 11, 2006; "Disposable Thin Wall Core Die, Methods of Manufacture Thereof and Articles Manufactured Therefrom"; Hsin-Pang Wang et al.

U.S. Appl. No. 11/609,150, filed Dec. 11, 2006, "Method of Modifying the End Wall Contour in a Turbine Using Laser Consolidation and the Turbines Derived Therefrom" Ching-Pang Lee et al.

* cited by examiner

CERAMIC CORES, METHODS OF MANUFACTURE THEREOF AND ARTICLES MANUFACTURED FROM THE SAME

BACKGROUND

This disclosure relates to ceramic cores, methods of manufacture thereof and articles manufactured from the same.

Components having complex geometry, such as components having internal passages and voids therein, are difficult to cast using currently available methods. The tooling used for the manufacture of such parts is both expensive and time consuming, often requiring a significant lead-time. This situation is exacerbated by the nature of conventional molds comprising a shell and one or more separately formed ceramic cores. The ceramic cores are prone to shift during casting, leading to low casting tolerances and low casting efficiency (yield). Examples of components having complex geometries that are difficult to cast using currently available methods include hollow airfoils for gas turbine engines, and in particular relatively small, double-walled airfoils. Examples of such airfoils for gas turbine engines include rotor blades and stator vanes of both turbine and compressor sections, or any parts that need internal cooling.

In current methods for casting hollow parts, a ceramic core and shell are produced separately. The ceramic core (for providing the hollow portions of the hollow part) is first manufactured by pouring a slurry that comprises a ceramic into a metal core die. After curing and firing, the slurry is solidified to form the ceramic core. The ceramic core is then encased in wax and a ceramic shell is formed around the wax pattern. The wax that encases the ceramic core is then removed to form a ceramic mold in which a metal part may be cast. These current methods are expensive, have long lead-times, and have the disadvantage of low casting yields due to lack of reliable registration between the core and shell that permits movement of the core relative to the shell during the filling of the ceramic mold with molten metal.

Development time and cost for airfoils are often increased because such components generally require several iterations, sometimes while the part is in production. To meet durability requirements, turbine airfoils are often designed with increased thickness and with increased cooling airflow capability in an attempt to compensate for poor casting tolerance, resulting in decreased engine efficiency and lower engine thrust. Improved methods for casting turbine airfoils will enable propulsion systems with greater range and greater durability, while providing improved airfoil cooling efficiency and greater dimensional stability.

Double wall construction and narrow secondary flow channels in modern airfoils add to the complexity of the already complex ceramic cores used in casting of turbine airfoils. Since the ceramic core identically matches the various internal voids in the airfoil which represent the various cooling channels and features it becomes correspondingly more complex as the cooling circuit increases in complexity.

With reference now to the FIG. 1, an exemplary double wall turbine airfoil 100 comprises a main sidewall 12 that encloses the entire turbine airfoil. As may be seen in the FIG. 1, the main sidewall 12 comprises a leading edge and a trailing edge. Within the main sidewall 12 is a thin internal wall 14. The main sidewall 12 and the thin internal wall 14 together form the double wall. As may be seen, the airfoil comprises a plurality of short channel partitions 13, 15, 17, 19 and 21. The double wall construction is formed between short channel partitions 17, 19 and 21 whose ends are affixed to the main sidewalls. As can be seen in the FIG. 1, there are a plurality of channels 16, 18, 20, 22, 24, 26, 28, 30 and 32 formed between the main sidewall 12, the channel partitions and the thin internal wall 14. The channels permit the flow of a fluid such as air to effect cooling of the airfoil. There are a number of impingement cross-over holes disposed in the partition walls such as the leading edge impingement cross-over holes 2, the mid-circuit double wall impingement cross over holes 4 and 6, and the trailing edge impingement cross-over holes 8 through which air can also flow to effect a cooling of the airfoil.

As may be seen in the FIG. 1, the exemplary double wall airfoil comprises four impingement cavities 22, 24, 26 and 28 in the mid-chord region. The impingement cavities 22, 24, 26 and 28 are formed between the main sidewall 12 and the thin internal wall 14. While the double wall construction of the FIG. 1 provides adequate cooling during the operation of the turbine airfoil, it is difficult to manufacture a ceramic core that comprises all features of the cooling passages 22, 24, 26 and 28 during a single operation.

The double wall construction is therefore difficult to manufacture because the core die cannot be used to form a complete integral ceramic core. Instead, the ceramic core is manufactured as multiple separate pieces and then assembled into the complete integral ceramic core. This method of manufacture is therefore a time consuming and low yielding process.

It is therefore desirable to have an improved process that accurately and rapidly produces the complete integral ceramic core for double wall airfoil casting without having to manufacture multiple separate pieces and then assembling them.

SUMMARY

Disclosed herein is an article comprising a solidified first portion of a ceramic core; wherein the first solidified portion is manufactured by a process comprising disposing a slurry comprising ceramic particles into a metal core die; wherein an internal volume of the metal core die has a geometry equivalent to a portion of the geometry of the integral casting core; curing the slurry to form a cured first portion of the ceramic core; firing the cured first portion of the ceramic core to form a solidified first portion of the ceramic core; and a solidified second portion of the ceramic core; wherein the solidified second portion is disposed upon the solidified first portion of the ceramic core by laser consolidation.

Disclosed herein is a method of manufacturing an integral casting core comprising disposing a slurry comprising ceramic particles into a metal core die; wherein an internal volume of the metal core die has a geometry equivalent to a portion of a geometry of an integral casting core; curing the slurry to form a cured first portion of the ceramic core; firing the cured first portion of the ceramic core to form a solidified first portion of the ceramic core; and laser consolidating a solidified second portion of the ceramic core onto the solidified first portion of the ceramic core to form the integral casting core.

Disclosed herein is a method of manufacturing an article comprising disposing a first slurry comprising ceramic particles into a metal core die; wherein an internal volume of the metal core die has a geometry equivalent to a portion of a geometry of an integral casting core; curing the first slurry to form a cured first portion of the ceramic core; firing the cured first portion of the ceramic core to form a solidified first portion of the ceramic core; laser consolidating a solidified second portion of the ceramic core onto the solidified first portion of the ceramic core to form the integral casting core; disposing the integral casting core in a wax die; wherein the wax die comprises a metal; injecting wax between the integral casting core and the wax die; cooling the injected wax to form a wax component with the integral casting core enclosed therein; immersing the wax component into a second slurry; wherein the second slurry comprises ceramic particles; firing the wax component to create a ceramic outer shell; removing the wax from the wax component during the firing process; disposing molten metal into the ceramic outer shell to form a desired metal article; and removing the ceramic outer shell and the integral casting core to release the article.

DETAILED DESCRIPTION OF FIGURES

DETAILED DESCRIPTION

Figure 1:
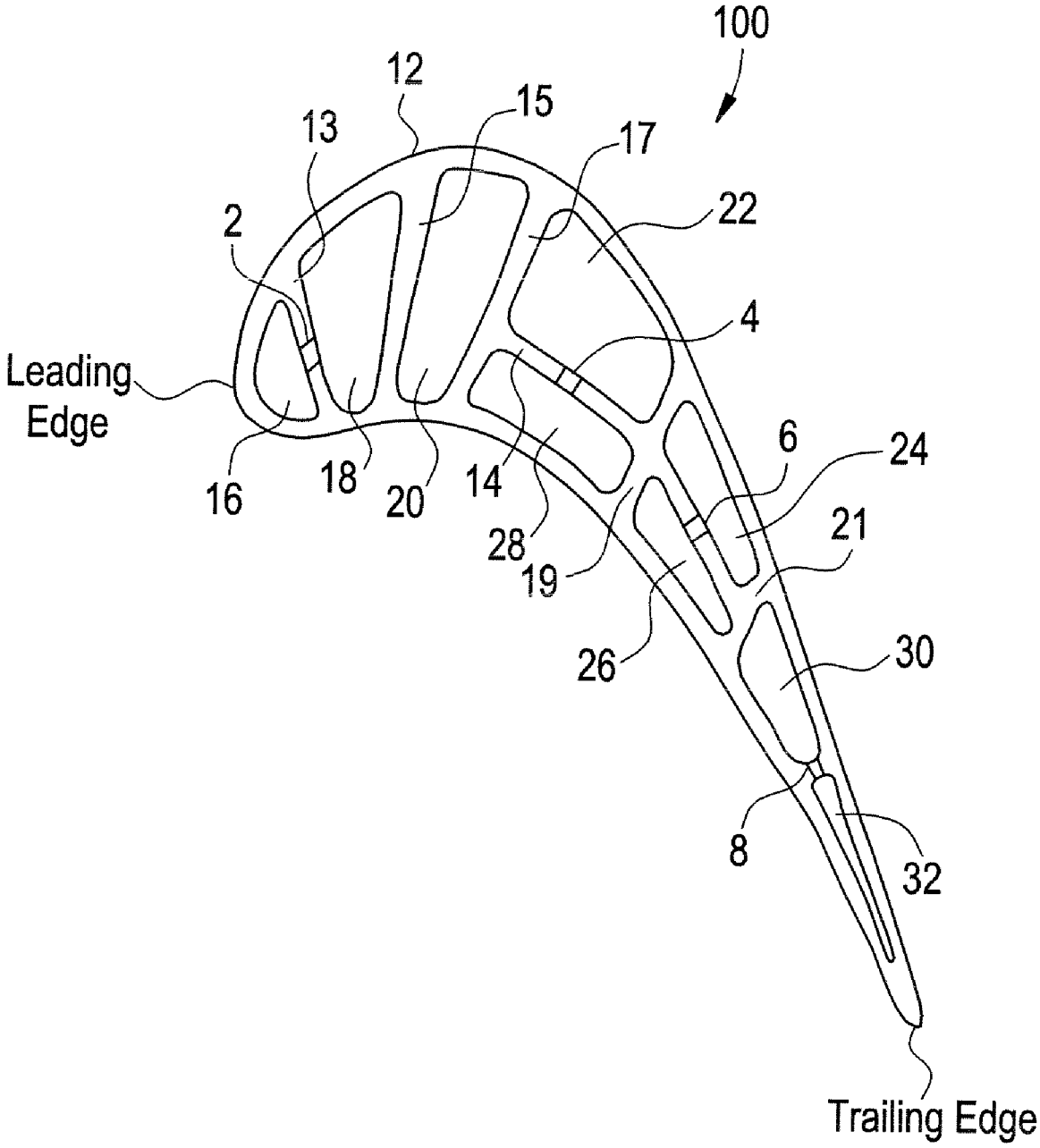
FIG. 1 is an exemplary depiction of a cross-sectional view of a double wall turbine airfoil.

The use of the terms "a" and "an" and "the" and similar references in the context of describing the invention (especially in the context of the following claims) are to be construed to cover both the singular and the plural, unless otherwise indicated herein or clearly contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

Disclosed herein is a method of manufacturing a ceramic core for casting turbine airfoils that comprises laser consolidation of sections of the ceramic core. In an exemplary embodiment, a first portion of the ceramic core is manufactured by pouring a slurry into a portion of a metal core die. The slurry is cured and fired to form the first portion of the ceramic core. The first portion is generally the main portion of the ceramic core, i.e., it comprises a larger portion of the integral casting core than the other portions (e.g., second, third, fourth, and so on, portions that are added on). The second portion of the ceramic core is then disposed onto the first portion of the ceramic core via laser consolidation to form an integral casting core. The second portion is also referred to as the secondary portion of the ceramic core. Manufacturing the ceramic core via laser consolidation improves manufacturing accuracy and speed by preventing the breaking of the core into multiple pieces followed by an assembly into one integral core as is conducted in a conventional manufacturing process.

The metal core die that is used to manufacture the first portion of the ceramic core (main portion) generally has selected channels blocked off or alternatively filled with a filler that prevents the slurry from entering into the channel. Alternatively, the metal core die may be constructed without certain selected channels, if desired. It is generally desirable to block those channels that prevent the opening of the metal core die to recover a cured core die. A slurry comprising ceramic particles is then disposed into the metal core die.

It is generally desirable for the metal core die (that is used to produce the first portion of the ceramic core) to comprise channels that comprise a total volume that is greater than or equal to about 50% of the total volume of the integral casting core. In one embodiment, the total volume of the channels in the metal core die is greater than or equal to about 60% of the total volume of the integral casting core. In another embodiment, the total volume of the channels in the metal core die is greater than or equal to about 70% of the total volume of the integral casting core.

The slurry generally comprises particles of a ceramic that upon firing solidify to form a solidified ceramic core whose shape and volume is substantially identical with the internal shape and volume of the metal core die. The slurry upon being disposed in the interstices and channels of the metal core die is then cured to form a cured first portion of the ceramic core. Upon curing of the slurry, the metal core die is removed.

The cured first portion of the ceramic core thus obtained is fired to obtain a solidified first portion of the ceramic core. The second portion of the ceramic core (secondary portion) is then disposed onto the first portion of the ceramic core via laser consolidation to form the integral casting core.

The integral ceramic core is then disposed inside a wax die. The wax die is made from a metal. Wax is injected between the integral casting core and the metal. The wax is allowed to cool. The wax die is then removed leaving behind a wax component with the integral casting core enclosed therein. The wax component is then subjected to an investment casting process wherein it is repeatedly immersed into a ceramic slurry to form a ceramic slurry coat whose inner surface corresponds in geometry to the outer surface of the desired component. The wax component disposed inside the ceramic slurry coat is then subjected to a firing process wherein the wax is removed leaving behind a ceramic mold. Molten metal may then be poured into the ceramic mold to create a desired metal component. As noted above, the component can be a turbine component such as, for example, a turbine airfoil.

Figure 2:
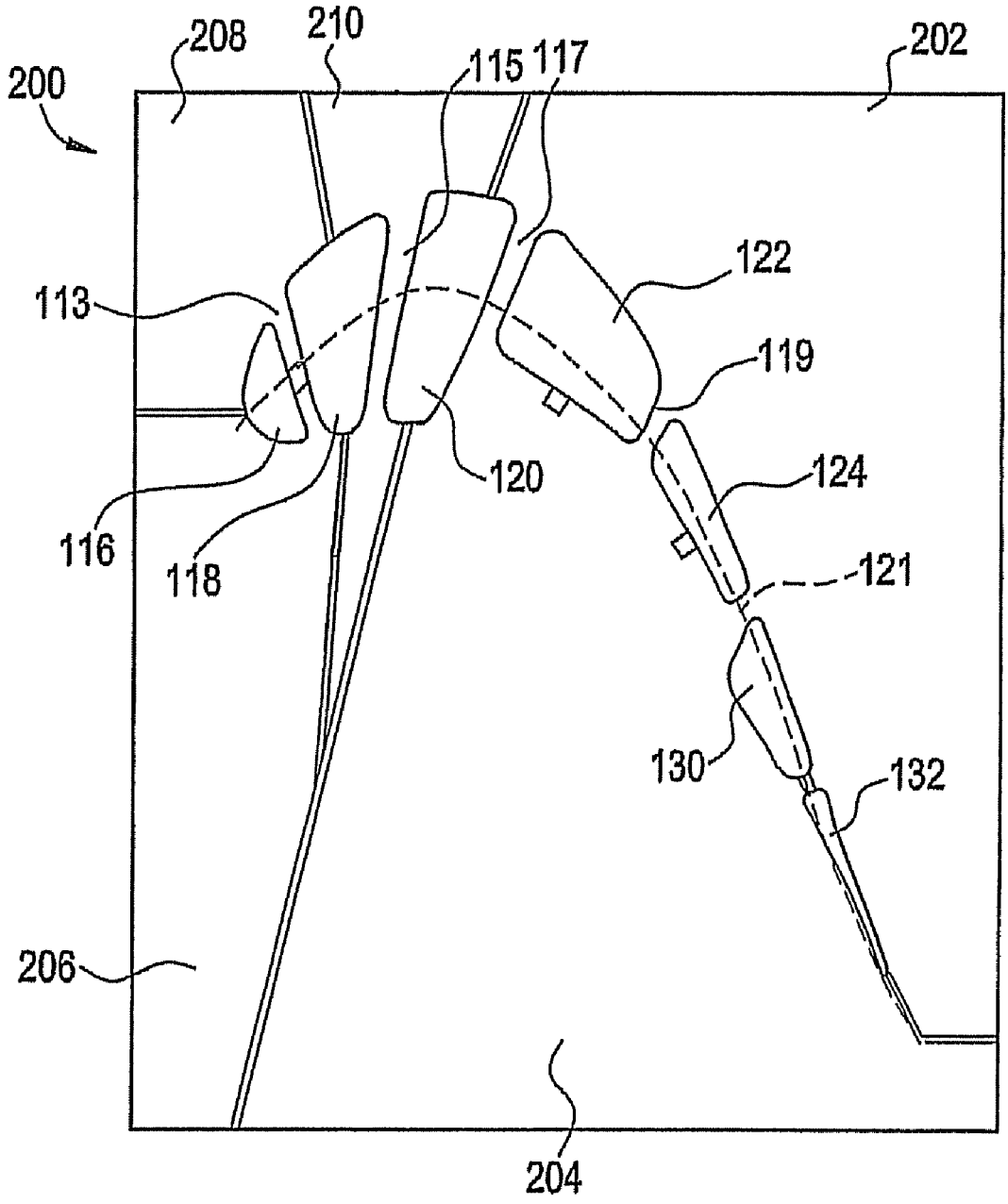
FIG. 2 depicts a cross-sectional view of a metal core die for manufacturing the solidified first portion of the ceramic core.

With reference now to the FIG. 2, a metal core die 200 for manufacturing the first portion of the ceramic core comprises a plurality of core dies 202, 204, 206, 208 and 210. As shown in the FIG. 2, when the plurality of core dies 202, 204, 206, 208 and 210 are combined, they produce the metal core die 200 that comprises a plurality of short channel partitions 113, 115, 117, 119 and 121. Also included in the metal core die 200 are a plurality of channels 116, 118, 120, 122, 124, 130 and 132 formed between the plurality of core dies.

Figure 3:
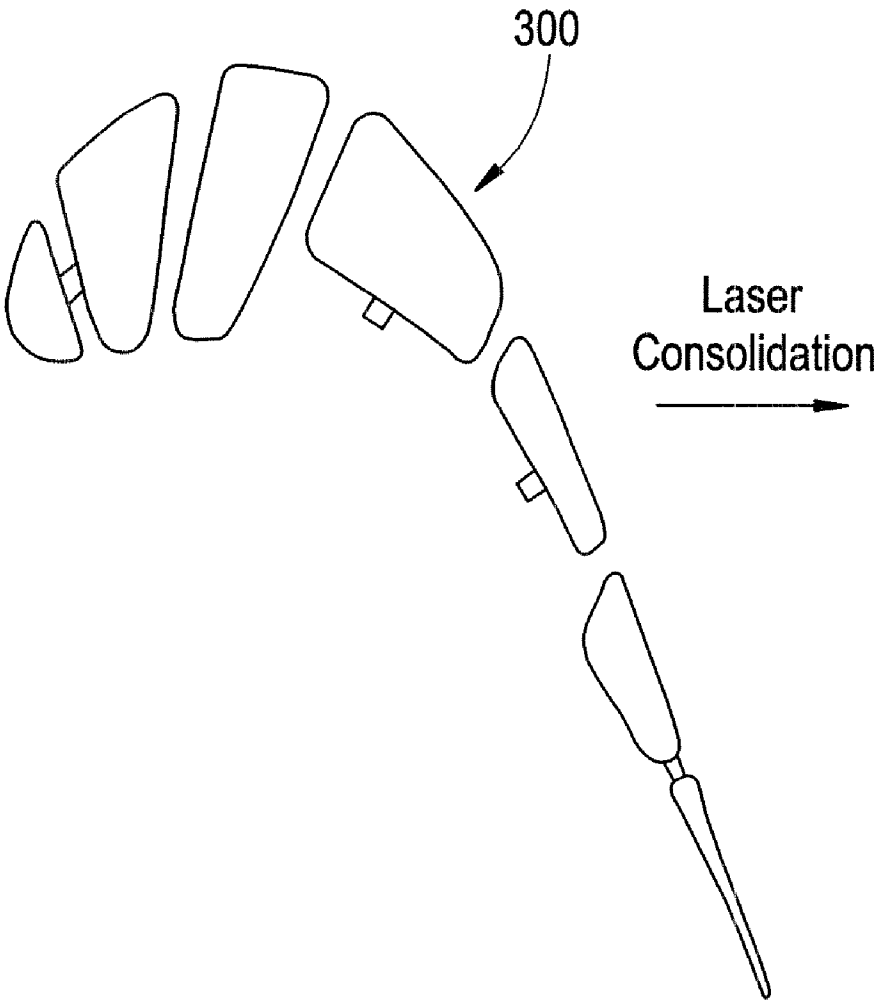
FIG. 3 is an exemplary depiction of a cross-sectional view of the solidified first portion of the ceramic core obtained from the metal core die.

The slurry is cast into the metal core die 200. Upon curing of the slurry, a cured first portion of the ceramic core is removed from the metal core die. The cured first portion of the ceramic core is then subjected to firing to form the solidified first portion of the ceramic core. FIG. 3 is an exemplary depiction of the solidified first portion of the ceramic core 300 obtained from the metal core die 200.

Figure 4:
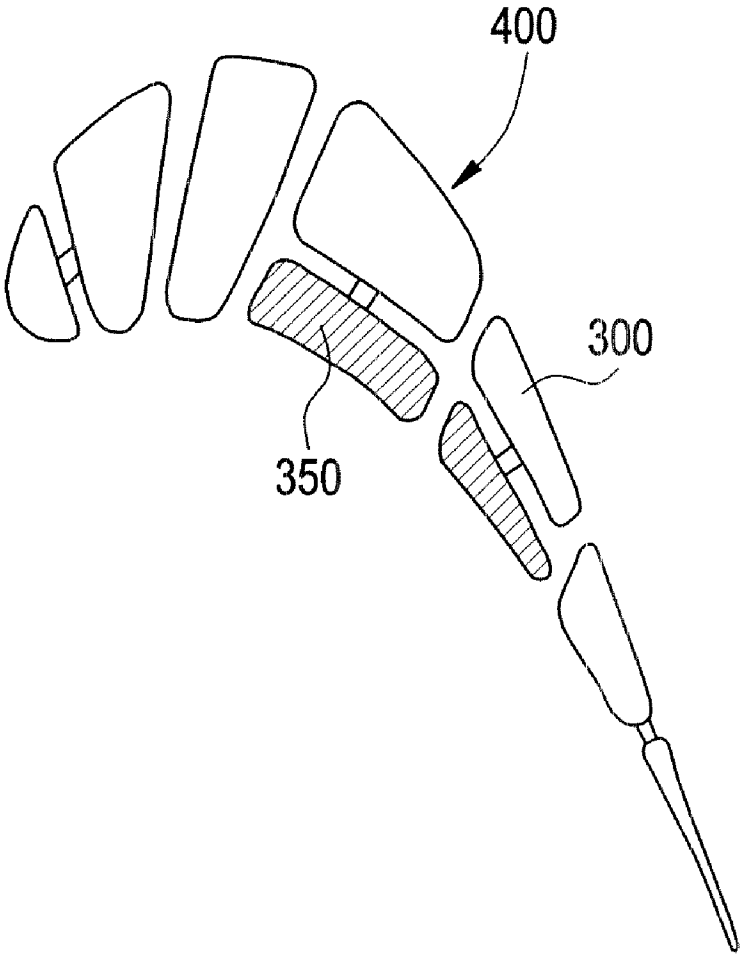
FIG. 4 is an exemplary depiction of a cross-sectional view showing the solidified first portion of the ceramic core with the solidified second portion of the ceramic core disposed thereon to form the integral casting core.

As can be seen from the FIG. 4, the solidified second portion 350 having the geometry and volumes to form the integral casting core are then disposed onto the solidified first portion in a laser deposition process. FIG. 4 is an exemplary depiction showing the solidified first portion of the ceramic core 300 with the solidified second portion of the ceramic core 350 disposed thereon to form the integral casting core 400.

As noted above, the solidified second portion 350 (the secondary portion) is prepared by a laser consolidation process. Such a process is generally referred to by a variety of other names as well. They include "laser cladding", "laser welding", "laser engineered net shaping", and the like. ("Laser consolidation" or "laser deposition" will usually be the terms used herein). Non-limiting examples of the process are provided in the following U.S. patents, which are incorporated herein by reference: U.S. Pat. No. 6,429,402 (Dixon et al); U.S. Pat. No. 6,269,540 (Islam et al); U.S. Pat. No. 5,043,548 (Whitney et al); U.S. Pat. No. 5,038,014 (Pratt et al); U.S. Pat. No. 4,730,093 (Mehta et al); U.S. Pat. No. 4,724,299 (Hammeke); and U.S. Pat. No. 4,323,756 (Brown et al). The equipment and processes used for laser consolidation are described in detail in U.S. application Ser. Nos. 11/240,837 and 11/172,390, the entire contents of which are hereby incorporated by reference.

In general, laser beam consolidation processes involve the feeding of a consumable powder or wire into a melt pool on the surface of a substrate. The substrate is usually a base portion of the article to be formed by the process. In the present instance, the solidified first portion of the ceramic core provides the substrate surface upon which the laser consolidation occurs. The melt pool is generated and maintained through the interaction with the laser beam, which provides a high-intensity heat source. The substrate is scanned relative to the beam. As the scanning progresses, the melted substrate region and the melted deposition material solidify, and a clad track is deposited on the surface. A layer is successively formed by depositing successive tracks side-by-side. Multilayer structures are generated by depositing multiple tracks on top of each other.

Ceramic core materials used in the laser consolidation process are generally in powder form. In general, any ceramic material can be used in the solidified second portion 350. It is generally desirable to use ceramics that can be removed with a suitable leaching material. Precursors to the desired ceramic materials could also be used. Examples of suitable ceramics include alumina, zirconia, silica, yttria, magnesia, calcia, ceria, or the like, or a combination comprising at least one of the foregoing. Alumina and alumina-containing mixtures are often the preferred core materials. The ceramic core material may also include a variety of other additives, such as binders. As further described below, the powder size of the ceramic material will depend in large part on the type of powder, and the type of laser deposition apparatus.

The solidified second portion of the ceramic core that is deposited by laser consolidation generally has the dimensions of the channels or interstices that are blocked off prior to the casting of the slurry into the metal core die.

In one embodiment plurality of different solidified portions may be laser consolidated onto the solidified first portion of the ceramic core to form the integral casting core. In another embodiment, a solidified third, a fourth and/or a fifth portion of the ceramic core may be added to the solidified first portion of the ceramic core by laser consolidation. The integral casting core may then be used to manufacture a desired component or article as described above. This method can also be advantageously used for manufacturing the integral casting core for double wall turbine airfoils.

In one embodiment, the portion of the ceramic core added through laser consolidation generally has a volume of less than 50% of the total volume of the integral casting core. In another embodiment, the portion of the ceramic core added through laser consolidation generally has a volume of less than 30% of the total volume of the integral casting core. In yet another embodiment, the portion of the ceramic core added through laser consolidation generally has a volume of less than 20% of the total volume of the integral casting core. In yet another embodiment, the portion of the ceramic core added through laser consolidation generally has a volume of less than 5% of the total volume of the integral casting core.

This method of forming the integral casting core is advantageous because the conventional core die process can be used to produce the solidified first portion of the ceramic core for a lower cost and with a higher yield. The laser consolidation facilitates deposition of the secondary portions of the ceramic core on the main portion of the core without further assembly requirements.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A method of manufacturing an integral casting core comprising:

disposing a slurry comprising ceramic particles into a metal core die; wherein an internal volume of the metal core die has a geometry equivalent to a portion of a geometry of an integral casting core; the metal core die having channels; wherein the channels comprise a total volume that is greater than or equal to about 50% of the total volume of the integral casting core;

curing the slurry to form a cured first portion of the ceramic core;

firing the cured first portion of the ceramic core to form a solidified first portion of the ceramic core; and laser consolidating a solidified second portion of the ceramic core onto the solidified first portion of the ceramic core to form the integral casting core.

2. The method of claim 1, wherein the solidified second portion comprises a ceramic material.

3. The method of claim 2, wherein the ceramic material comprises alumina, zirconia, silica, yttria, magnesia, calcia, ceria, or a combination comprising at least one of the foregoing ceramic materials.

4. The method of claim 1, wherein the solidified second portion of the ceramic core is multilayered.

5. The method of claim 1, further comprising laser consolidating a plurality of different solidified portions onto the solidified first portion of the ceramic core to form the integral casting core.

6. The method of claim 1, further comprising laser consolidating a solidified third, fourth and/or a fifth portion of the ceramic core onto the solidified first portion of the ceramic core to form the integral casting core.

7. A method of manufacturing an article comprising:

disposing a first slurry comprising ceramic particles into a metal core die; wherein an internal volume of the metal core die has a geometry equivalent to a portion of a geometry of an integral casting core;

curing the first slurry to form a cured first portion of the ceramic core;

firing the cured first portion of the ceramic core to form a solidified first portion of the ceramic core;

laser consolidating a solidified second portion of the ceramic core onto the solidified first portion of the ceramic core to form the integral casting core;

disposing the integral casting core in a wax die; wherein the wax die comprises a metal;

injecting wax between the integral casting core and the wax die;

cooling the injected wax to form a wax component with the integral casting core enclosed therein;

immersing the wax component into a second slurry; wherein the second slurry comprises ceramic particles;

firing the wax component to create a ceramic outer shell;

removing the wax from the wax component during the firing process;

disposing molten metal into the ceramic outer shell to form a desired metal article; and removing the ceramic outer shell and the integral casting core to release the article.

8. The method of claim 7, wherein the article is a turbine airfoil.

* * * * *

UNITED STATES PATENT AND TRADEMARK OFFICE

CERTIFICATE OF CORRECTION

PATENT NO. : 7,938,168 B2
APPLICATION NO. : 11/567521
DATED : May 10, 2011
INVENTOR(S) : Lee et al.

It is certified that error appears in the above-identified patent and that said Letters Patent is hereby corrected as shown below:

On the Title Page, Item (57), under "ABSTRACT", in Column 2, Lines 1-13, delete "Disclosed herein is an integral.....portion of the ceramic core." and insert -- Disclosed herein is an article including a solidified first portion of a ceramic core; wherein the first solidified portion is manufactured by a process including disposing a slurry including ceramic particles into a metal core die; wherein an internal volume of the metal core die has a geometry equivalent to a portion of the geometry of the integral casting core; curing the slurry to form a cured first portion of the ceramic core; firing the cured first portion of the ceramic core to form a solidified first portion of the ceramic core; and a solidified second portion of the ceramic core; wherein the solidified second portion is disposed upon the solidified first portion of the ceramic core by laser consolidation. --, therefor.

In Column 3, Line 12, in Heading, delete "DETAILED" and insert -- BRIEF --, therefor.

Signed and Sealed this
Seventh Day of February, 2012

David J. Kappos

David J. Kappos
*Director of the United States Patent and Trademark Office*